United States Patent [19]

Allen et al.

[11] Patent Number: 5,048,381

[45] Date of Patent: Sep. 17, 1991

[54] TORQUE-INDICATING SCREWDRIVER

[75] Inventors: David G. Allen, Chiddingfold; Terence C. Bullen, Guildford, both of England

[73] Assignee: MHH Engineering Co., Ltd. of Bramley, Etc., England

[21] Appl. No.: 503,771

[22] Filed: Apr. 3, 1990

[30] Foreign Application Priority Data

Apr. 21, 1989 [GB] United Kingdom ..... 8909169
Oct. 11, 1989 [GB] United Kingdom ..... 8922886

[51] Int. Cl.[5] ..... B25B 23/159
[52] U.S. Cl. ..... 81/477; 73/862.21
[58] Field of Search ..... 81/477, 467, 478, 480–483; 73/862.21, 862.22, 862.23

[56] References Cited

U.S. PATENT DOCUMENTS

| | | | |
|---|---|---|---|
| 2,394,022 | 2/1946 | Storrie | 73/862.21 |
| 2,400,978 | 5/1946 | Collins | 73/862.21 |
| 2,417,402 | 3/1947 | Storrie | 73/862.21 |
| 2,464,372 | 3/1949 | Booth | 73/862.21 |
| 3,783,682 | 1/1974 | Lipari | 73/862.23 |
| 4,249,435 | 2/1981 | Villeneuve et al. . | |
| 4,461,491 | 7/1984 | Booth . | |

FOREIGN PATENT DOCUMENTS

| | | |
|---|---|---|
| 2056837 | 5/1971 | Fed. Rep. of Germany . |
| 1322916 | 11/1973 | United Kingdom . |

*Primary Examiner*—D. S. Meislin
*Attorney, Agent, or Firm*—Kenyon & Kenyon

[57] ABSTRACT

A torque-indicating screwdriver comprises a shaft assembly and a handle. There is also a fastener coupling which enables a fastener to be coupled to an end of the shaft assembly. The shaft assembly comprises a torsionally elastic torque transmitter which is preferably a torsion bar which couples the handle to the fastener coupling. An indicator is also provided and is coupled between the handle and the fastener coupling to provide an indication of the relative torque applied through the torsionally elastic torque transmitter to the fastener coupling by rotation of the handle. In addition, or as an alternative, the indicator may be coupled between the handle and the fastener coupling to provide an indication of the peak torque applied through the torsionally elastic torque transmitter to the fastener coupling by rotation of the handle so that the indicator remains at the peak indication until it is reset.

6 Claims, 6 Drawing Sheets

TORQUE-INDICATING SCREWDRIVER

This invention relates to torque-indicating screwdrivers.

BACKGROUND OF THE INVENTION

For the purposes of this specification, a screwdriver is a manually-operable tool having a shaft, a handle at one end of the shaft, and a fastener-engaging bit at the other end of the shaft (the fastener-engaging bit possibly being substituted by a plug or a socket (or other coupling) for the temporary attachment of a detachable fastener-engaging bit of a selected size and/or shape). The fastener to be operated by the screwdriver may be a screw, a bolt, a nut or some other form of fastener, such fasteners having the common characteristic that they are all operated by rotation (either for tightening or loosening), the requisite torque being delivered to the fastener through the shaft of the screwdriver. More effective use of such fasteners may be achieved if the torque applied by the screwdriver to the fastener is known with a reasonable degree of precision, as distinct from the relatively haphazard estimation by the user of manual effort being applied through the screwdriver.

SUMMARY OF THE INVENTION

According to a first aspect of the present invention there is provided a torque-indicating screwdriver, the screwdriver comprising a shaft assembly, a handle and a fastener coupling to enable a fastener to be coupled to an end of the shaft assembly, the shaft assembly comprising a torsionally elastic torque transmitter rotationally coupling the handle to the fastener coupling, and an indicator coupled between the handle and the fastener coupling to provide an indication of the relative torque being applied through the torsionally elastic torque transmitter to the fastener coupling by rotation of the handle.

According to a second aspect of the present invention there is provided a torque-indicating screwdriver, the screwdriver comprising a shaft assembly, a handle and a fastener coupling to enable a fastener to be coupled to an end of the shaft assembly, the shaft assembly comprising a torsionally elastic torque transmitter rotationally coupling the handle to the fastener coupling and an indicator coupled between the handle and the fastener coupling to provide an indication of the peak torque applied through the torsionally elastic torque transmitter to the fastener coupling by rotation of the handle and to remain at the peak indication until reset.

In both aspects of the invention, the torsionally elastic torque transmitter is preferably a torsion bar which may comprise one or two elastic strips fixedly coupled at one end to the handle and fixedly coupled at the other end to the fastener coupling.

The shaft assembly preferably comprises a substantially inelastic sleeve substantially coaxiably enclosing said torque transmitter, the sleeve being coupled at one end to the fastener coupling and the other end of the sleeve being rotationally coupled to the indicator whereby the sleeve couples the indicator to the fastener coupling.

Typically, the indicator comprises an angularly calibrated disc rotationally coupled to the fastener coupling, the rotational coupling of the disc to the fastener coupling being through the sleeve if provided. The indicator preferably further comprises a cursor rotationally coupled to the handle, whereby relative movement of the cursor and the calibrated disc provides an indication of the torque applied to the coupling in use of the screwdriver. The rotational coupling of the calibrated disc to the coupling is preferably a frictional coupling loose enough to enable the disc to be manually preset at a selected angle relative to the cursor in zero-torque conditions prior to a given use of the screwdriver, but tight enough that the disc remains angularly invariant with respect to the fastener coupling during fastener-turning use of the screwdriver; for example, the cursor and the disc can thereby be relatively preset to indicate zero torque prior to use of the screwdriver, or the cursor and the disc can be mutually offset in a direction opposite to their relative motion in next use of the screwdriver and by a predetermined amount indicative of a required torque in next use of the screwdriver such that when motion of the cursor relative to the disc in next use of the screwdriver brings the cursor to a "zero" calibration on the disc, an indication is thereby given that the required torque has been reached. The frictional coupling of the calibrated disc to the fastener coupling may be adjustable.

In the first aspect of the invention, the cursor may be rigidly coupled to the handle, or formed integrally therewith.

Alternatively, in the second aspect of the invention, the cursor may be coupled to the handle through a unidirectional rotation transmitter and further coupled by a frictional coupling to the fastener coupling such that while increasing torque is being applied in use of the screwdriver, the cursor is rotated relative to the calibrated disc by means of the unidirectional rotation transmitter, and such that during subsequent reduction in fastener-turning torque, the cursor is frictionally coupled to the fastener coupling and simultaneously rotationally decoupled from the handle by means of the unidirectional rotation transmitter whereby the rotation of the cursor relative to the disc remains at the peak relative rotation and thereby indicates the peak torque last transmitted by the screwdriver in use thereof.

The unidirectional rotation transmitter preferably comprises a projection on the handle and a projection on the cursor, the cursor being rotatable relative to the handle to bring these two projections into mutual engagement in a direction which results in the requisite direction of unidirectional rotation transmission. Rotation of the cursor in the opposite direction relative to the handle will bring these two projections into mutual engagement in the opposite direction such as to reverse the direction of unidirectional transmission.

Typically, the handle includes a manually operable latch which is operable either to delatch the cursor for rotation relative to the handle, or to latch the cursor to the handle at a rotational position intermediate the positions at which said projections come into mutual engagement, such that when the cursor is delatched from the handle, the screwdriver has a peak-torque-indicating function in accordance with the second aspect of the invention, and when the cursor is latched to the handle, the cursor is rotationally locked to the handle and the screwdriver has an alternative instantaneous torque-indicating function in accordance with the first aspect of the invention.

BRIEF DESCRIPTION OF THE DRAWINGS

Examples of a torque-indicating screwdriver in accordance with the invention will now be described with reference to the accompanying drawings, in which.

DESCRIPTION OF PREFERRED EMBODIMENTS

Figure 1:
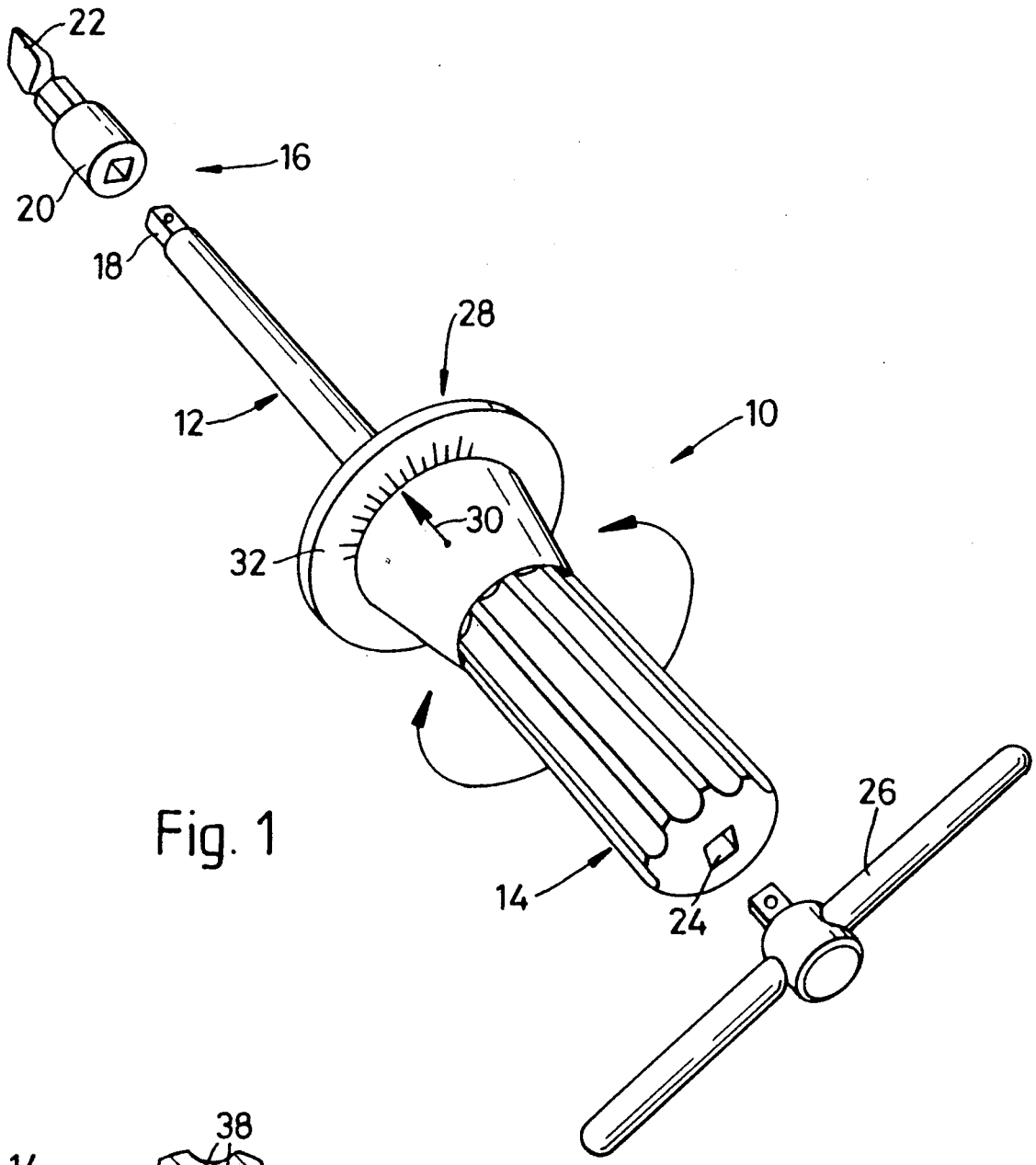
FIG. 1 is a perspective view of a torque-indicating screwdriver.

FIG. 1 shows a torque-indicating screwdriver 10 which comprises a shaft assembly 12, a handle 14 at one end of the shaft assembly 12, and a bit coupling 16 at the other end of the shaft assembly 12. The bit coupling 16 consists of a square-section plug 18 on the end of the shaft assembly 12, a double-ended socket 20 with a square socket at one end to fit on the plug 18 and a hexagonal socket (not visible in FIG. 1) at the other end for temporary attachment of a detachable fastener-engaging bit, such as the flat-blade screwdriver bit 22 illustrated by way of example.

The handle 14 is longitudinally fluted to improve its ability to be tightly gripped. The end of the handle 14 remote from the bit coupling 16 is provided with a square socket 24 (shown in FIG. 1 only) for temporary attachment of a detachable tommy bar 26 when fastener-turning torque is required in excess of that which can readily be provided by manual grip directly on the handle 14. (In FIG. 2, the socket 24 is replaced by a plain-faced plug-in blanking cap 25).

Figure 2:
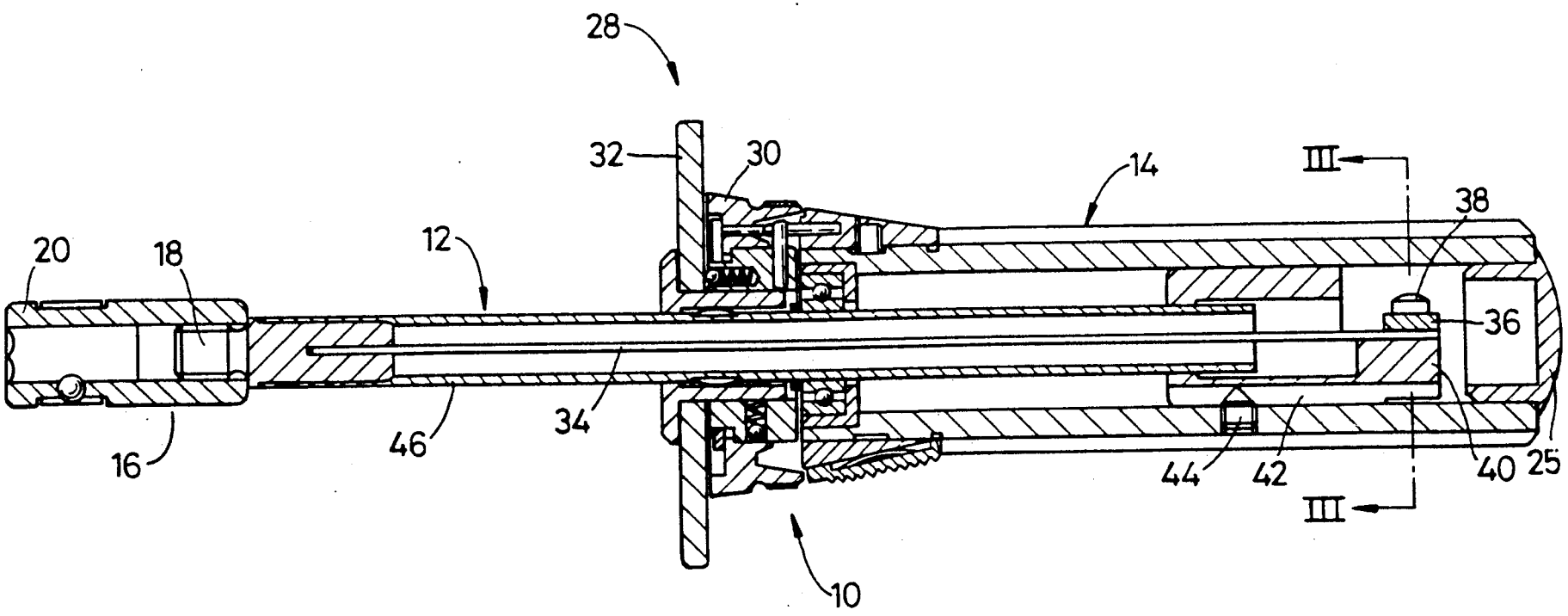
FIG. 2 is a longitudinal sectional elevation of the screwdriver of FIG. 1 showing a first example of an indicator.
Figure 4:
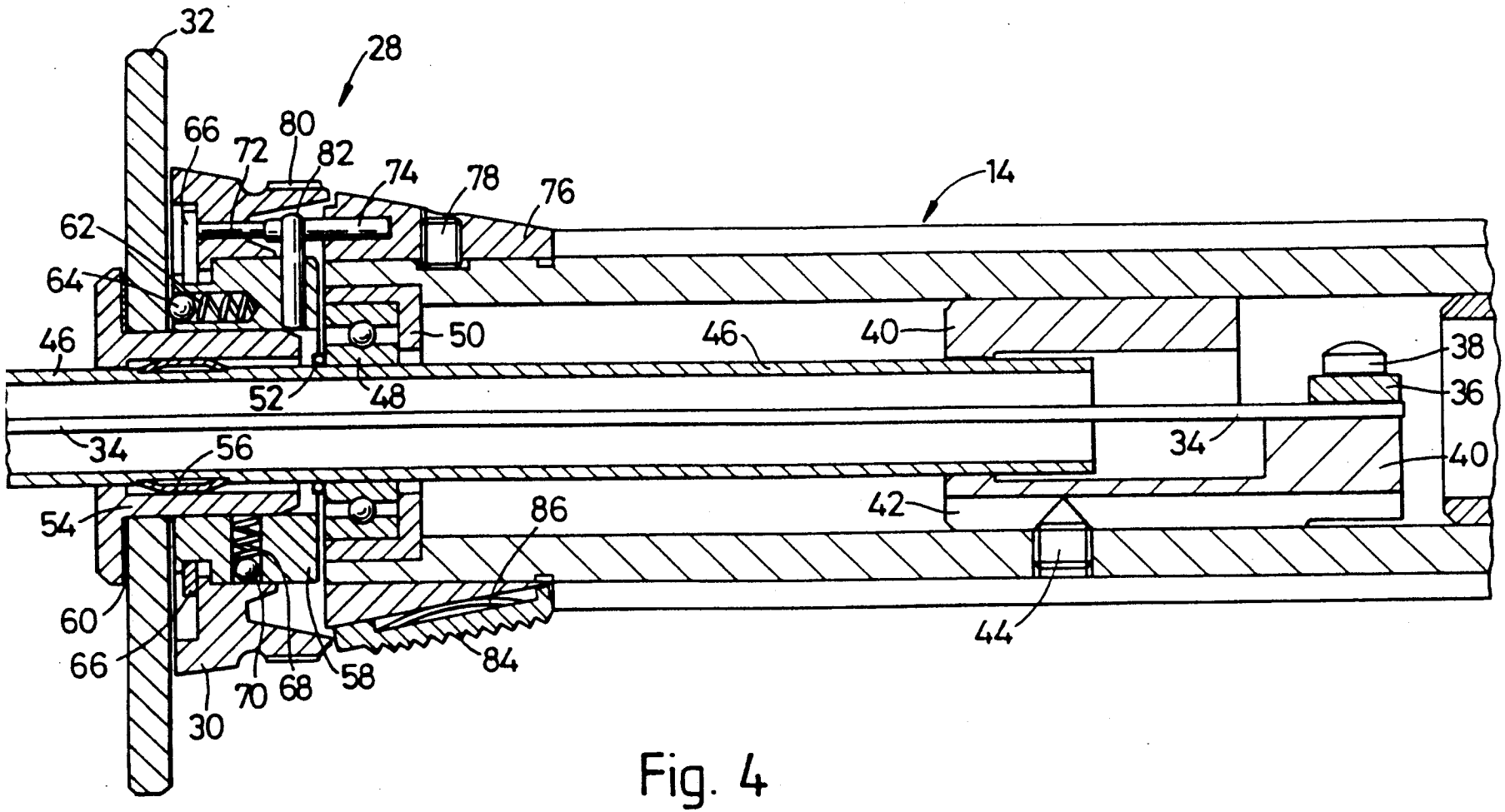
FIG. 4 is a longitudinal sectional elevation, to an enlarged scale, of the central part of the screwdriver shown in FIG. 2.
Figure 5:
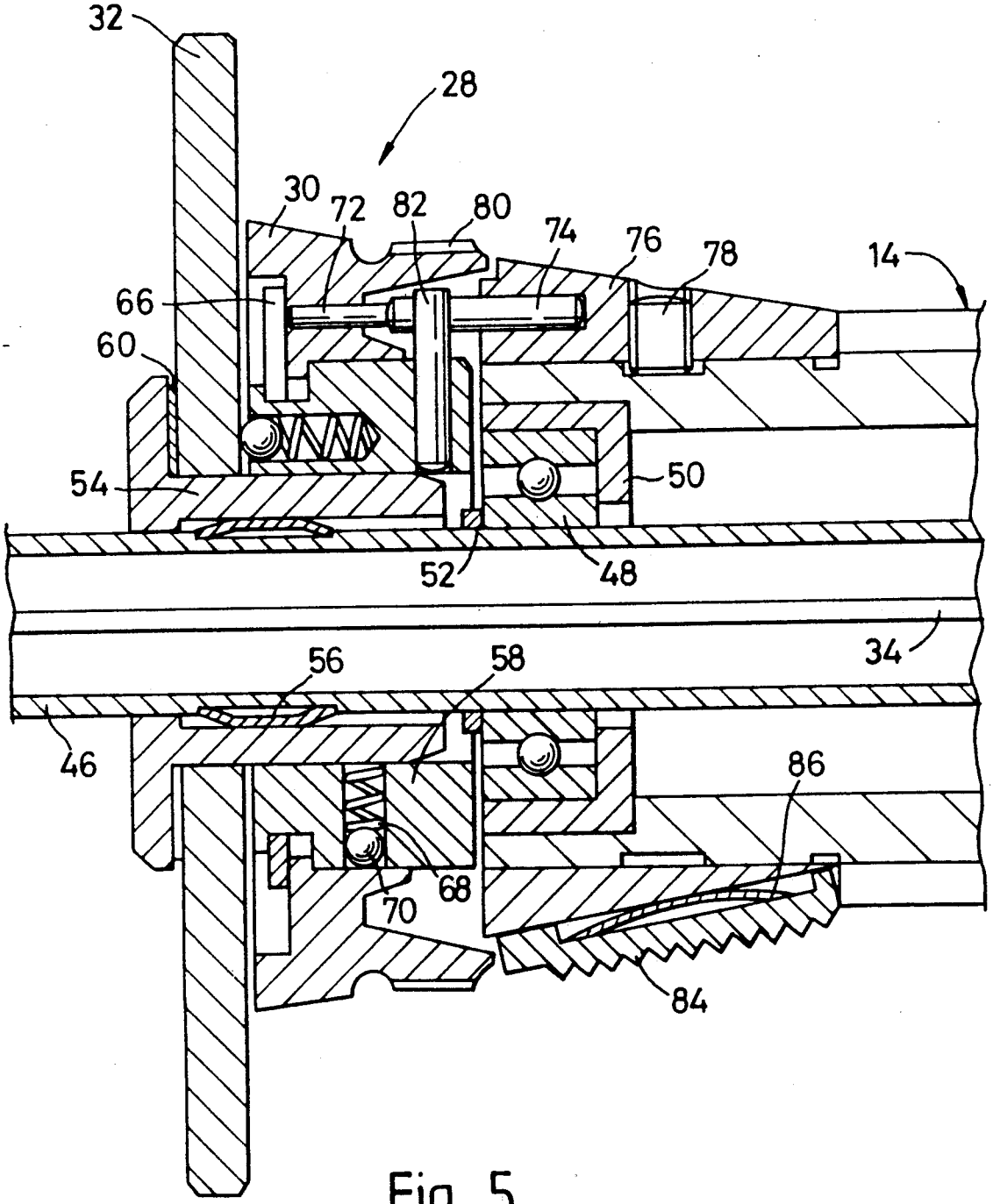
FIG. 5 is a longitudinal section elevation showing in detail, the first example of an indicator.

The screwdriver 10 further comprises an indicator 28 a first example of which is shown in FIGS. 2, 4 and 5, and which is rotationally coupled between the shaft assembly 12 and the handle 14. In the first example, the indicator 28 comprises a cursor 30 rotationally coupled to the handle 14, and an angularly calibrated disc 32 indirectly rotationally coupled to the bit coupling 16 through part of the shaft assembly 12.

Figure 3:
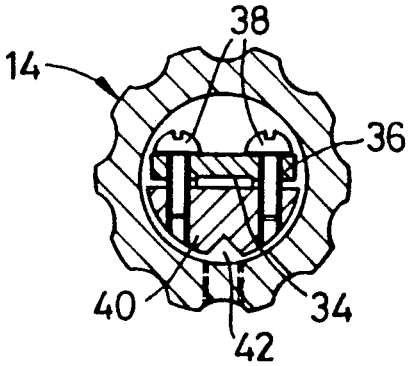
FIG. 3 is a cross-sectional view taken on the line III—III in FIG. 2.

Further details of the screwdriver 10 not visible in FIG. 1 will now be described with reference to FIGS. 2, 3 and 4.

The shaft assembly 12 comprises a torsionally elastic torque transmitter in the form of a torsion bar 34 rotationally coupled at one end to the bit coupling 16 (by being embedded in a slot in the inner end of the square-section plug 18), and rotationally coupled at the other end to the handle 14. The torsion bar 34 as illustrated comprises a strip of spring steel, but may alternatively comprise two such strips mounted back-to-back. The torsion bar is not directly connected to the handle 14, but is clamped at or near its end by a clamp bar 36 and screws 38 to a part-cylindrical insert 40 which loosely fits inside the hollow interior of the handle 14. The insert 40 has a hollow groove 42 extending the length of its outer peripheral surface. The insert 40 (and hence the torsion bar 34) is rotationally coupled to the handle 14 by a cone-pointed screw 44 secured in the handle 14 and projecting inwardly to engage the groove 42. The effective length of the torsion bar 34, and hence the amount of the relative rotation between the opposite ends of the torsion bar 34 per unit of torque transmitted along the torsion bar 34, is adjustable by turning the screws 38 so as to loosen the clamp bar 36 and unclamp the torsion bar 34, sliding the inset 40 along by a suitable amount, and retightening the screws 38 so as to reclamp the torsion bar 34 under the clamp bar 36. For convenience, such adjustment of the effective length of the torsion bar 34 would take place prior to final assembly of the screwdriver 10, preferably in a torque-calibrating jig. The groove 42 and the screw 44 allow the insert 40 to be rotationally coupled to the handle 14 in a wide range of longitudinal positions corresponding to a similar range of effective lengths of the torsion bar 34.

The shaft assembly 12 further comprises a rigid sleeve or tube 46 secured at one end around the exterior of the square-section plug 18, the tube 46 thereby being rotationally connected to the adjacent end of the torsion bar 34.

The tube 46 encloses the torsion bar 34 and extends through the indicating means 28 into the interior of the handle 14 to terminate within the insert 40. The tube 46 is a loose fit within the insert 40 such that the tube 46 is not rotationally coupled to the insert 40 but the tube 46 is laterally supported by the insert 40 during their relative rotation (as detailed below) so as to maintain the integrity of the overall assembly of components forming the screwdriver 10, during use thereof. Within the end of the handle 14 nearer the bit coupling 16, the tube 46 and the handle 14 are mutually radially supported for relative rotation, substantially without friction, by a single-row radial-contact ball bearing 48. The handle 14 radially and axially contacts the outer race of the bearing 48 through a bearing sleeve 50. The inner race of the bearing 48 rests directly on the tube 46, where it is axially retained by a plain wire ring 52. The bearing 48 has the additional function of transmitting axial thrust from the handle 14 through the shaft assembly 12 to the bit coupling 16 substantially without rotational friction that would inhibit fully torque-responsive relative rotation of the cursor 30 and the angularly calibrated disc 32.

The disc 32 is indirectly mounted on the tube 46 by being rotatably mounted on a shouldered sleeve 54 which is secured to the tube 46 by a star tolerance ring 56. The disc 32 is axially retained on the sleeve 54 by a stop collar 58 which is secured on the sleeve 54 by being an interference fit, or in any other suitable manner. A friction washer 60 is fitted between the disc 32 and the shoulder of the sleeve 54. The disc 32 is biassed against the friction washer 60 by a compression spring 62 set into a recess in the adjacent end face of the collar 58 and acting on the disc 32 through a bearing ball 64. Thereby the angularly calibrated disc 32 is indirectly frictionally coupled to the bit coupling 16. (The disc 32 could instead be rotationally fixed to the bit coupling 16, but the preferred frictional coupling has operational advantages, such as setting adjustability, as will be detailed below when describing the operation of the screwdriver 10). The spring 62 and the ball 64 could be replaced by a circumferentially corrugated "wave" washer (not shown) to provide a similar axial thrust.

Figure 7A:
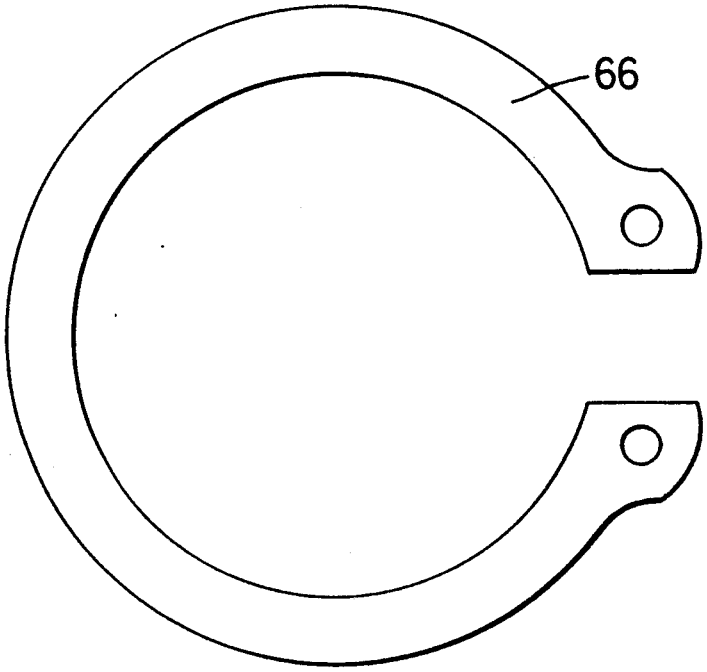
Figure 7B:
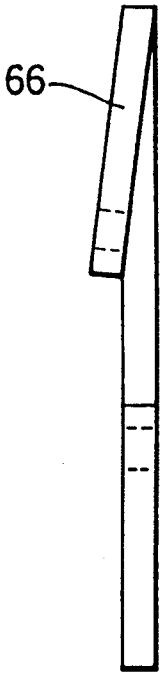

The cursor 30 is in the form of a ring which is rotatably mounted on the outside of the collar 58 where the cursor ring 30 is axially retained in the rightward direction by an internal shoulder and in the leftward direction by an external circlip 66. The cursor ring 30 is frictionally coupled to the collar 58 by the circlip 66 which is twisted slightly to provide a helical form (see FIGS. 7A and 7B), the pitch of the helix being approximately the material thickness. As the circlip groove extends inwards beyond the end face of the cursor ring 30, any axial clearance between the cursor ring 30 and the collar 58 is taken up by the spring effect of the circlip 66 which because of the small set provides minimal drag. Since the collar 58 is rotationally fixed to the sleeve 54 which in turn is rotationally fixed to the tube 46 of the sleeve assembly 12, the cursor ring 30 is thereby frictionally coupled (albeit indirectly) to the bit coupling 16; the cursor ring 30 will therefore tend to rotate with the bit coupling 16 unless the cursor ring 30 is constrained to rotate with the handle 14, as happens in certain circumstances which are detailed below.

The cursor ring 30 is intermittently linked to the handle 14 for rotation therewith by a unidirectional rotation transmitter comprising a pin 72 projecting axially from an undercut in the handle end of the cursor ring 30, and a pin 74 projecting axially from a bezel 76 secured to the adjacent end of the handle 14 by two setscrews 78 (only one shown) positioned radially, 90 apart.

To bring this unidirectional rotation transmitter constituted by the projecting pins 72 and 74 into operation in a selected direction, the cursor ring 30 is manually rotated in one direction, manual grip of the cursor ring 30 being aided by a circumferential knurl 80. This "one direction" is selected as follows:- assuming for example that the screwdriver 10 is to be utilized for clockwise rotation as viewed from the end of the handle 14 remote from the bit coupling 16, the cursor ring 30 is rotated in the opposite direction, i.e. anticlockwise, until the anticlockwise side of the pin 72 comes into contact with the clockwise side of the pin 74, as illustrated.

The angularly calibrated disc 32 is then manually rotated on the sleeve 54 until the disc 32 has a selected angular relationship with respect to the cursor 30; for example the cursor 30 can thereby be preset against a "zero" calibration on the disc 32.

Finally, a suitable fastener-engaging bit (for example, the flat-blade screwdriver bit 22 illustrated in FIG. 1) is inserted into the hexagonal end of the socket 20, and the screwdriver 10 is manipulated to bring this bit into engagement with the fastener (not shown). The handle 14 is then rotated clockwise (in continuing accordance with the example given above) such that clockwise fastener-turning torque is transmitted along the torsion bar 34, which is thereby angularly deflected in proportion to the torque. The angularly calibrated disc 32 is rotationally coupled to the bit coupling 16 (and hence to the fastener) as previously detailed, while the cursor ring 30 is carried clockwise by the clockwise contact of the pin 74 against the pin 72. During this positive rotational linking of the handle 14 to the cursor ring 30, the frictional coupling of the cursor ring 30 to the collar 58, and hence ultimately to the fastener engaging bit, is of no significant effect on movement of the cursor ring 30 relative to the calibrated disc 32. This positive rotational linking of the handle 14 to the cursor ring 30 persists for so long as the fastener-turning torque does not decrease, i.e. up to and for the duration of peak fastener-turning torque.

As soon as fastener-turning torque commences to decrease, i.e. following the application of peak torque, angular deflection of the torsion bar 34 commences to decrease in proportion to the reduction in torque. This reduces angular deflection of the handle 14 relative to the bit coupling 16, carrying the pin 74 anticlockwise relative to the pin 72 and hence out of mutual contact. The cursor ring 30 is now rotationally decoupled from the handle 14 and is instead frictionally linked to the collar 58, and hence ultimately to the bit coupling 16. Because the disc 32 is also frictionally coupled to the collar 58 (and assuming the absence of any extraneous disturbance of the angular position of the disc 32), the cursor ring 30 is now rotationally static relative to the disc 32, the cursor ring 30 being decoupled from the handle 14 which is moving anticlockwise (in this continuing example) relative to the disc 32 during this period of reducing torque.

Ultimately, when all manual torque is removed from the screwdriver 10, the handle 14 returns to its zero-torque starting position relative to the disc 32, but the cursor ring 30 will remain turned to its peak-torque position relative to the angularly calibrated disc 32. Thus the relative rotation indication given by the position of the cursor 30 is a continuing measure of the peak fastener-turning torque applied through the screwdriver 10 during its last fastener-turning use. This peak-torque indication will last (in the absence of extraneous disturbances) until the relative rotation indicating means 28 is reset by manual rotation of the disc 32 on the sleeve 54 following resetting of the pins 72 and 74 into mutual contact by rotation of the cursor ring 30 relative to the bezel 76 and the handle 14.

Overstressing of the torsion bar 34 is prevented by limiting the peak rotation of the handle 14 relative to the bit coupling 16. Such rotation limitation can be achieved in any suitable manner, one possibility being illustrated (by way of example) as one or more stop pins 82 projecting radially from the collar 58 at suitable angular positions to obstruct the handle-carried pin 74 at a predetermined peak torsional deflection of the torsion bar 34 and thereby prevent further increase in torsional stress. (In the drawings, the single illustrated stop pin 82 is depicted at an angular position on the collar 58 which is angularly displaced from the position in which the stop pin 82 would be located in practice; this dislocation is merely to clarify the overall relationship of the stop pin 82 and the remainder of the screwdriver 10 without being definitive of its actual angular position). In a preferred arrangement, there are two such stop pins, angularly displaced by 95 degrees on either side of a median position.

While the screwdriver 10 as detailed above has a peak-torque-indicating function (which is retained until reset), the screwdriver 10 can be converted to an instantaneous (non-retentive) torque-indicating function by a simple expedient which will now be described.

The bezel 76 fixed to the handle 14 has a dovetail slot longitudinally cut in its outer surface, and is fitted with a manually operable slider 84 with tapered sides to fit in the slot with freedom to slide but with radial retention. A curved leaf spring 86 fitted in a rear recess of the slider 84 exerts an outward force between the base of the slot and the back of the slider 84 to enhance frictional forces tending to retain the slider 84 in whichever longitudinal position (relative to the bezel 76) that the slider 84 is manually set. As illustrated, the slider 84 is retracted towards the handle end of the bezel 76, but the slider 84 can be longitudinally repositioned in the general direction of the bit coupling 16, as detailed below.

The edge of the cursor ring 30 which is adjacent to the bezel 76 has a small notch (not visible in the drawings) in the vicinity of the pin 72. When the cursor ring 30 is rotated until the pin 72 is approximately diametrally opposite the pin 74 so as to bring the notch opposite the slider 84, the slider 84 can be moved in the general direction of the bit coupling 16 until the nose of the slider 84 enters the notch in the cursor ring 30. Thereafter the cursor ring 30 is rotationally locked to the handle 14 so as completely to over-ride the frictional coupling between the cursor ring 30 and the collar 58 that was critical to the peak-torque-indicating function.

When the cursor ring 30 is rotationally locked to the handle 14 by the above-described movement of the slider 84, instantaneous movement of the cursor ring 30 relative to the disc 32 is an indication of the instantaneous rotation of the handle 14 relative to the bit coupling 16, and hence of the instantaneous fastener-turning torque being transferred by the screwdriver 10 in this mode of operation.

During instantaneous torque-indicating use of the screwdriver 10, the disc 32 can be rotationally preset to a desired position relative to the cursor 30 by manually turning the disc 32 on the sleeve 54 against the frictional coupling provided by the friction washer 60 and the spring 62. Such presetting can be presetting to a "zero" indication prior to use, or presetting in the opposite direction to relative movement in next use, by an amount equal to the relative movement equivalent to a requisite torque, such that upon the cursor searching a "zero" indication in next use, this is an indication that there is instantaneously zero discrepancy from the requisite torque.

The screwdriver 10 can readily be reconverted from the instantaneous torque-indicating mode of operation to the peak-torque-indicating mode of operation simply by manually moving the slider 84 out of the notch in the cursor ring 30, and manually rotating the cursor ring 30 in the appropriate direction relative to the handle 14 until the pins 72 and 74 come into contact in the appropriate direction, followed by zero-setting or presetting of the calibrated disc 32 relative to the cursor 30 in the zero-torque condition of the screw driver 10 prior to its use in this mode.

Figure 6:
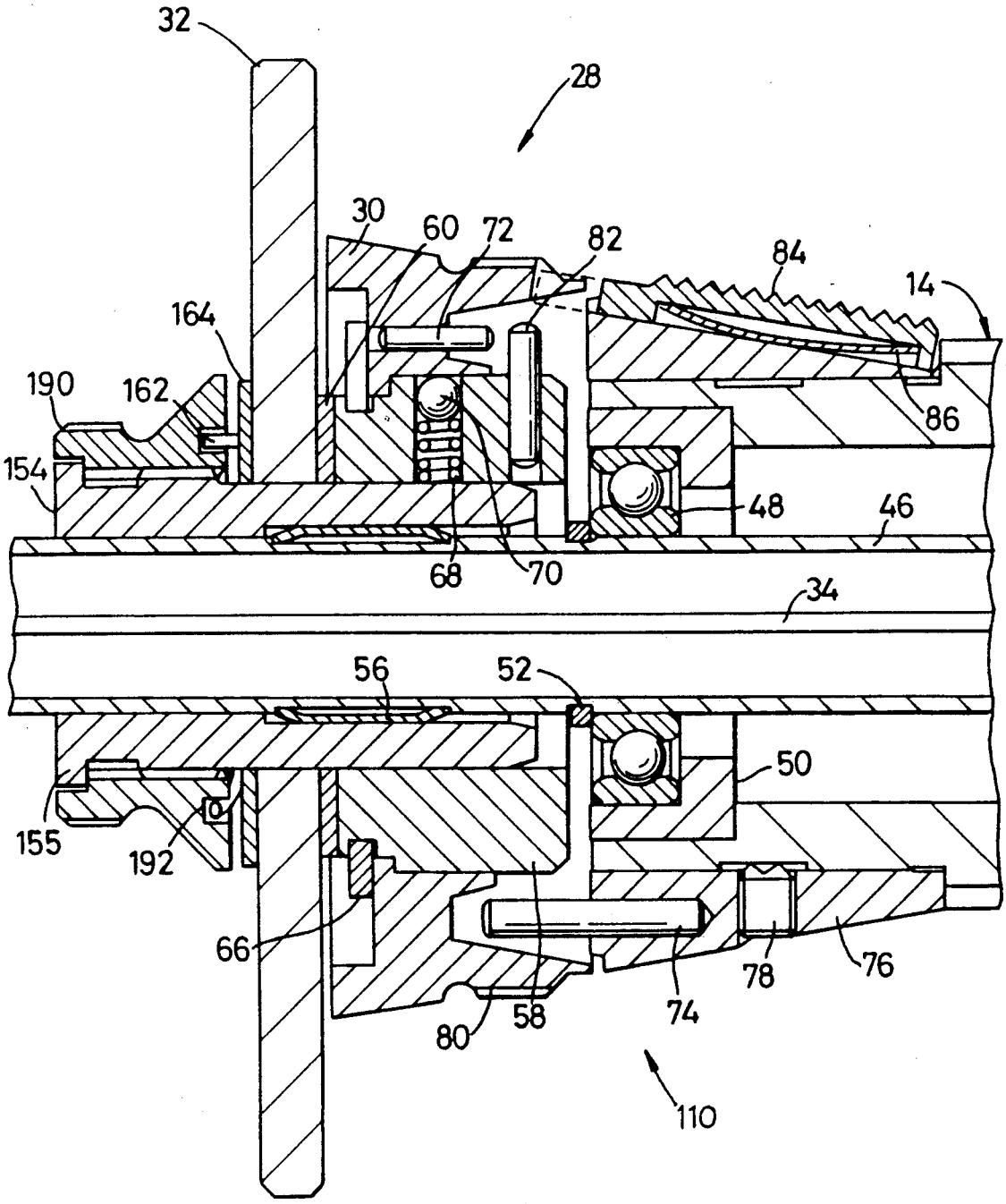
FIG. 6 is a longitudinal section elevation showing in detail a second example of an indicator; and, FIG. 7 and 7A show the configuration of a circlip for use in the screwdriver shown in FIGS. 1 to 6.

Referring now to FIG. 6, this is a longitudinal sectional elevation of a second example of an indicator 28. The parts of the screwdriver shown in FIG. 6 which functionally match equivalent parts of the screwdriver 10 shown in FIGS. 2 to 5 are indicated by the same reference numerals. In both location and scale, FIG. 6 is analogous to FIG. 5.

The principal difference between the indicator 28 of FIG. 6 and the indicator 28 of FIG. 5 lies in the details of the mechanism by which the angularly calibrated disc 32 is indirectly functionally coupled to the bit coupling 16, as may be seen by comparing FIG. 6 to the analogous FIG. 5.

Referring now to FIG. 6 in detail, the friction washer 60 is relocated on the axially opposite side of the disc 32, to lie between the collar 58 and the disc 32. The sleeve 54 is replaced by a modified sleeve 154 in which the formerly fixed shoulder of the sleeve 54 is replaced by a clamp nut 190 which is screw-threaded onto the sleeve 154. The axial position of the clamp nut 190 along the sleeve 154 is adjusted by rotating the nut 190 relative to the sleeve 154. A small end shoulder 155 on the sleeve 154 prevents the nut 190 becoming detached from the sleeve 154 in use of the screwdriver 110.

As previously envisaged in the description of the screwdriver 10, the spring 62 and the ball 64 are replaced in the screwdriver 110 by a circumferentially corrugated "wave"washer or "wave spring" 162 which functions as an axially-compressible spring and axially bears against the disc 32 through the intermediary of a washer 164. The wave spring 162 is housed in and axially projects from a circumferential groove or recess 19 in the end face of the nut 190.

As in the first example of the indicator 28, the stop collar 58 is secured on the sleeve 154 by being an interference fit, or in any other suitable manner. Thus the disc 32 is axially retained on the sleeve 154 while being rotatable relative thereto under the frictional restraint provided by the friction washer 60 in combination with the axial thrust from the wave spring 162.

This frictional restraint on rotation of the disc 32 relative to the sleeve 154 is adjustable by adjusting the position of the nut 190 along the sleeve 154 as previously described. In comparison to the first example of the indicator 28, the frictional adjustability of the second example shown in FIG. 6 permits greater flexibility in setting up the screwdriver 10 for satisfactory operation when new, allows user adjustment of disc friction to suit preference and/or to compensate for changes in frictional performance, and enables compensation for wear arising from prolonged use.

In all other respects, adjustment and use of the screwdriver 10 is substantially as previously described.

While certain modifications and variations have been described above, the invention is not restricted thereto, and other modifications and variations can be adopted without departing from the scope of the invention.

We claim:

1. A torque-indicating screwdriver comprising a shaft assembly, a handle and fastener coupling, the shaft assembly comprising a torsionally elastic torque transmitter rotationally coupling the handle to the fastener coupling, and a torque indicator, the torque indicator comprising:

first and second torque indicator members, the torque indicator members being mounted on the shaft assembly and the torque indicator members being movable relative to each other to indicate torque;

a uni-directional rotation transmitter means mounted on the handle, the uni-directional rotation transmitter means engageable with the first member to move the first member with the handle in one rotational direction; and a latch mounted on the handle, the latch means being movable between a lock position in which it engages the first member and locks the first member to the handle for movement therewith in two rotational directions, and a release position in which the latch means is disengaged from the first member and the first member is unlocked from the handle.

2. A torque-indicating screwdriver according to claim 1, wherein the first and second torque indicator members are mounted on the shaft assembly and the shaft assembly comprises a substantially inelastic sleeve substantially co-axially enclosing the torque transmitter, the sleeve being coupled at one end to the fastener coupling and the other end of the sleeve being rotationally coupled to the first and second torque indicator members.

3. A torque-indicating screwdriver according to claim 1, wherein the torsionally elastic torque transmitter is a torsion bar.

4. A torque-indicating screwdriver according to claim 1, wherein the second torque indicator member is rotatable relative to the fastener coupling.

5. A torque-indicating screwdriver according to claim 4, wherein the second torque indicator member is coupled to the fastener coupling by a frictional coupling.

6. A torque-indicating screwdriver according to claim 1, wherein the uni-directional rotation transmitter means comprises a projection on the handle and a projection on the first torque indicator member.

* * * * *